US010035359B2

(12) United States Patent
Ikeda et al.

(10) Patent No.: US 10,035,359 B2
(45) Date of Patent: Jul. 31, 2018

(54) INKJET PRINTER AND PRINTING METHOD

(71) Applicant: MIMAKI ENGINEERING CO., LTD., Nagano (JP)

(72) Inventors: Akira Ikeda, Nagano (JP); Kazuyuki Takeuchi, Nagano (JP); Masayoshi Morisawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/304,070

(22) PCT Filed: Apr. 16, 2015

(86) PCT No.: PCT/JP2015/061653
§ 371 (c)(1),
(2) Date: Oct. 14, 2016

(87) PCT Pub. No.: WO2015/159933
PCT Pub. Date: Oct. 22, 2015

(65) Prior Publication Data

US 2017/0036457 A1 Feb. 9, 2017

(30) Foreign Application Priority Data

Apr. 16, 2014 (JP) ..... 2014-084937
Apr. 16, 2014 (JP) ..... 2014-084938

(51) Int. Cl.
*B41J 2/01* (2006.01)
*B41J 3/407* (2006.01)
*B41J 29/393* (2006.01)

(52) U.S. Cl.
CPC ..... *B41J 3/4073* (2013.01); *B41J 2/01* (2013.01); *B41J 29/393* (2013.01)

(58) Field of Classification Search
CPC ..... B41J 3/4073; B41J 2/01; B41J 29/393
See application file for complete search history.

(56) References Cited

U.S. PATENT DOCUMENTS 5,581,284 A * 12/1996 Hermanson ..... B41J 2/04505 347/40
6,196,652 B1 * 3/2001 Subirada ..... B41J 2/2135 347/19

(Continued)

FOREIGN PATENT DOCUMENTS

JP 2001-205794 7/2001
JP 2002-084407 3/2002

(Continued)

OTHER PUBLICATIONS

"Office Action of China Counterpart Application," with English translation thereof, dated May 3, 2017, p. 1-p. 13.

(Continued)

*Primary Examiner* — Lamson Nguyen
(74) *Attorney, Agent, or Firm* — JCIPRNET

(57) ABSTRACT

To provide an inkjet printer and a printing method that can print a new pattern to be printed at an appropriate position relative to an existing pattern. An inkjet printer newly prints a new pattern to be printed, that is different from an existing pattern, on an outer surface of a spherical print object on which the existing pattern is printed. The inkjet printer includes a retainer that retains the print object, a carriage, and a projector. The carriage prints the new pattern to be printed on the outer surface of the print object. The projector projects at least a part of the existing pattern and the new pattern to be printed together on the outer surface of the print object retained by the retainer.

18 Claims, 9 Drawing Sheets

(56) References Cited

U.S. PATENT DOCUMENTS

| | | | | |
|---|---|---|---|---|
| 7,935,389 | B2 * | 5/2011 | Takahashi | B41J 11/009 118/666 |
| 8,978,551 | B2 * | 3/2015 | Miller | B41F 17/006 101/35 |
| 9,427,046 | B2 * | 8/2016 | Miller | A43B 3/0078 |

FOREIGN PATENT DOCUMENTS

| | | |
|---|---|---|
| JP | 2006-069104 | 3/2006 |
| JP | 2006069104 | 3/2006 |
| JP | 2007-244669 | 9/2007 |
| JP | 2007244669 | 9/2007 |
| JP | 2008-191903 | 8/2008 |
| JP | 2009-153539 | 7/2009 |
| JP | 2012-000603 | 1/2012 |
| JP | 3189987 U | 4/2014 |

OTHER PUBLICATIONS

"International Search Report (Form PCT/ISA/210) of PCT/JP2015/061653", dated Jun. 9, 2015, with English translation thereof, pp. 1-8.

"The partial supplementary Search Report of Europe Counterpart Application", dated Sep. 7, 2017, p. 1-p. 12.

"Office Action of Japan Counterpart Application," with English translation thereof, dated Jan. 23, 2018, p. 1-p. 7.

* cited by examiner

INKJET PRINTER AND PRINTING METHOD

CROSS-REFERENCE TO RELATED APPLICATION

This application is a 371 of international application of PCT application serial no. PCT/JP2015/061653, filed on Apr. 16, 2015, which claims the priority benefits of Japan application no. JP 2014-084937 filed on Apr. 16, 2014, and Japan application no. JP 2014-084938, filed on Apr. 16, 2014. The entirety of each of the above-mentioned patent applications is hereby incorporated by reference herein and made a part of this specification.

TECHNICAL FIELD

The present invention relates to an inkjet printer and a printing method.

BACKGROUND ART

In printing a desired pattern on a print object such as a ball, in some cases, the print object has been assembled by printing the desired pattern on outer skin panels configuring the print object, and assembling the outer skin panels on which the desired pattern is printed (for example, see Patent Literature 1).

Further, there has been a demand to manufacture three-dimensional print objects such as balls (for example, soccer balls) in small lots but in various types. In order to perform printing on such print objects that are manufactured in small lots but in various types, an inkjet printer provided with tools to accurately position the print objects in a horizontal direction or in a vertical direction has been used in some cases (for example, see Patent Literature 2).

CITATIONS LIST

Patent Literatures

Patent Literature 1: Japanese Unexamined Patent Publication No. 2009-153539

Patent Literature 2: Japanese Unexamined Patent Publication No. 2012-603

SUMMARY

Technical Problems

In the method disclosed in the aforementioned Patent Literature 1, the pattern is printed on the outer skin panels prior to the assembly of the print object, and thus no new pattern to be printed could have been printed on the print object on which the existing pattern has already been printed. Further, when the new pattern to be printed is to be printed on the print object on which the existing pattern is printed, the new pattern to be printed is required to be printed at an appropriate position relative to the existing pattern so as to prevent the aesthetic view of the print object from being failed.

In the inkjet printer disclosed in the aforementioned Patent Literature 2, when a shape of a print object being a print target is changed, respective parts of a tool need to be reassembled to accurately position the print object in a horizontal direction or in a vertical direction, and thus there has been a tendency of increase in burden related to print preparation work.

The present invention has been made in view of the above, and provides an inkjet printer and a printing method that can print a new pattern to be printed at an appropriate position relative to an existing pattern.

Further, the present invention has been made in view of the above, and provides an inkjet printer that can perform printing on outer surfaces of print objects with various types of shapes while suppressing burden related to preparation work.

Solutions to the Problems

The present invention is an inkjet printer configured to newly print a new pattern to be printed on an outer surface of a print object in spherical shape on which an existing pattern is printed, the new pattern being different from the existing pattern, the inkjet printer including: a retainer configured to retain the print object; a carriage configured to print the new pattern to be printed on the outer surface of the print object; and a projector configured to project at least a part of the existing pattern and the new pattern to be printed together on the outer surface of the print object retained by the retainer.

According to this invention, due to being provided with the projector that projects at least a part of the existing pattern and the new pattern to be printed, the print object can easily be positioned at a specified position prior to printing by the carriage based on at least a part of the existing pattern projected by the projector and the existing pattern printed on the outer surface of the print object. Further, since the projector projects at least a part of the existing pattern and the new pattern to be printed on the outer surface of the print object, at the time of positioning the print object, not only a position of the new pattern to be printed and an area to print it but also patterns (such as color and design) on the outer surface of the print object after the printing can easily be recognized along with the existing pattern already printed on the print object and surface convex and concave of the outer surface of the print object.

Further, in the inkjet printer as above, the projector may be configured to project, from within the existing pattern, a peripheral pattern of the new pattern to be printed as the part of the existing pattern on the outer surface of the print object together with the new pattern to be printed.

In this invention, since the projector projects the peripheral pattern, being a part of the existing pattern, around the new pattern to be printed, the print object can easily be positioned based on the projected patterns and the like.

Further, the present invention is an inkjet printer configured to newly print a new pattern to be printed on an outer surface of a print object in spherical shape on which an existing pattern is printed, the new pattern being different from the existing pattern, the inkjet printer including: a retainer configured to retain the print object; a carriage configured to print the new pattern to be printed on the outer surface of the print object; and a projector configured to project the new pattern to be printed on the outer surface of the print object retained by the retainer.

According to this invention, due to being provided with the projector that projects the new pattern to be printed, the print object can easily be positioned at the specified position prior to printing by the carriage based on the new pattern to be printed that is projected by the projector and the existing pattern printed on the outer surface of the print object. Further, since the projector projects the new pattern to be printed on the outer surface of the print object, at the time of positioning the print object, not only the position of the new pattern to be printed and the area to print it but also the patterns (such as color and design) on the outer surface of the print object after printing can easily be recognized along with the existing pattern already printed on the print object and the surface convex and concave of the outer surface of the print object.

Further, in the inkjet printer as above, the projector may arrange an irradiation region on a line passing through a center of the print object.

In this invention, since the projector arranges the irradiation region on the line passing through the center of the print object, the patterns projected by the projector can be prevented from distorting on the outer surface of the print object.

Further, the inkjet printer as above may further include a transporter that transports the retainer between a projected position where the print object is projected by the projector and a print position on the print object where printing is performed by the carriage.

In this invention, since the transporter that transports the retainer between the projected position and the print position is provided, a new pattern to be printed can be printed on the outer surface of the print object at the print position after having positioned the print object relative to the retainer at the projected position.

Further, in the inkjet printer as above, the carriage may move in a horizontal direction to print the new pattern to be printed on the outer surface of the print object.

In this invention, since the carriage prints the new pattern to be printed on the outer surface of the print object while moving in the horizontal direction, it can be suppressed that a carriage motion during printing becomes complex and driving voltages of piezoelectric elements for discharging ink do not have to be changed according to carriage positions.

Further, the printing method of the present invention is a printing method of newly printing a new pattern to be printed on an outer surface of a print object in spherical shape on which an existing pattern is printed, the new pattern being different from the existing pattern, the printing method including printing the new pattern to be printed on the outer surface of the object by a carriage of an inkjet printer after having projected at least a part of the existing pattern and the new pattern to be printed together on the outer surface of the print object, and the print object is positioned based on the existing pattern which is projected and the existing pattern printed on the outer surface of the print object.

According to this invention, due to at least a part of the existing pattern and the new pattern to be printed being projected, the print object can easily be positioned at a specified position prior to printing by the carriage based on at least a part of the existing pattern being projected and the existing pattern printed on the outer surface of the print object. Further, since at least a part of the existing pattern and the new pattern to be printed are projected on the outer surface of the print object, at the time of positioning the print object, not only the position of the new pattern to be printed and the area to print it but also patterns (such as color and design) on the outer surface of the print object after printing can easily be recognized along with the existing pattern already printed on the print object and the surface convex and concave of the outer surface of the print object.

Further, the printing method of the present invention is a printing method of newly printing a new pattern to be printed on an outer surface of a print object in spherical shape on which an existing pattern is printed, the new pattern being different from the existing pattern, the printing method including printing the new pattern to be printed on the outer surface of the print object by a carriage of an inkjet printer after having projected the new pattern to be printed on the outer surface of the print object, and the print object is positioned based on the new pattern to be printed which is projected and the existing pattern printed on the outer surface of the print object.

According to this invention, due to the new pattern to be printed being projected, the print object can easily be positioned at the specified position prior to printing by the carriage based on the new pattern to be printed that is projected and the existing pattern printed on the outer surface of the print object. Further, since the new pattern to be printed is projected on the outer surface of the print object, at the time of positioning the print object, not only the position of the new pattern to be printed and the area to print it but also the patterns (such as color and design) on the outer surface of the print object after printing can easily be recognized along with the existing pattern already printed on the print object and the surface convex and concave of the outer surface of the print object.

Further, the printing method as above may further include changing a print region of the print object to be printed by the carriage of the inkjet printer based on the new pattern to be printed projected on the outer surface of the print object.

In this invention, since the print region is changed based on the new pattern to be printed that is projected on the outer surface of the print object, the new pattern to be printed can accurately be printed on the outer surface of the print object by setting the print region at a position where the projected new pattern to be printed is not distorted.

Further, in order to solve the above problems and achieve the aims, an inkjet printer of the present invention is an inkjet printer configured to perform printing on an outer surface of a print object in three-dimensional shape, the inkjet printer including: a retainer configured to retain the print object; a rough position adjuster configured to change, by being operated, a distance in a vertical direction between the outer surface of the print object retained by the retainer and a carriage that is to perform printing on the outer surface; a transporter including a fine position adjuster capable of changing the distance in the vertical direction between the outer surface of the print object retained by the retainer and the carriage; and a controller configured to control the fine position adjuster so that the distance in the vertical direction between the outer surface of the print object retained by the retainer and the carriage becomes a suitable distance during the printing by the carriage.

According to this invention, a rough adjustment of the distance in the vertical direction between the outer surface of the print object retained by the retainer and the carriage can be performed by the rough position adjuster, and a suitable adjustment can be performed during the printing so that the distance in the vertical direction between the outer surface of the print object and the carriage becomes a suitable distance by the fine position adjuster controlled by the controller. Thus, since printing of print objects having various types of shapes is enabled by retaining the print object by the retainer, burden on preparation work is suppressed while at the same time printing can be performed on the outer surfaces of the print objects having various types of shapes.

Further, since the rough adjustment of the distance in the vertical direction between the outer surface of the print object retained by the retainer and the carriage can be performed by the rough position adjuster, a range within which the distance in the vertical direction between the outer surface of the print object and the carriage that the fine position adjuster must adjust during printing can be made small.

Thus, time required for printing on the outer surface of the print object can be shortened.

Further, in the inkjet printer as above, the transporter may further include a horizontal transporter that moves the retainer along a sub scanning direction of the carriage.

In this invention, since the transporter includes the horizontal transporter that moves the retainer in the sub scanning direction, printing can be performed on the outer surfaces of print objects having various types of shapes. Further, since the transporter moves the retainer relative to the carriage, a follow-up speed by the fine position adjuster for the distance between the outer surface of the print object and the carriage can be increased.

Further, in the inkjet printer as above, the horizontal transporter may further include a horizontal moving table that supports and moves the fine position adjuster along the sub scanning direction, and the fine position adjuster may move the retainer along the vertical direction.

In this invention, since the inkjet printer supports the fine position adjuster on the horizontal moving table of the horizontal transporter, the fine position adjuster moves the retainer in the vertical direction, as a result of which the follow-up speed by the fine position adjuster for the distance between the outer surface of the print object and the carriage can be increased.

Further, in the inkjet printer as above, the transporter may further include a vertical axis rotator configured to relatively rotate the retainer and the carriage about an axis parallel to the vertical direction.

In this invention, since the transporter includes the vertical axis rotator that relatively rotates the retainer, that is, the print object, and the carriage about the axis parallel to the vertical direction, a greater variety of types of patterns can be printed on print objects with a greater variety of types of shapes.

Further, in the inkjet printer as above, the fine position adjuster may include a vertical moving table that supports and moves the vertical axis rotator along the vertical direction, and the vertical axis rotator may be configured to rotate the retainer about the axis parallel to the vertical direction.

In this invention, since the inkjet printer supports the vertical axis rotator on the vertical moving table, the fine position adjuster rotates the retainer about the axis parallel to the vertical direction, as a result of which a follow-up speed by the fine position adjuster about the aforementioned axis can be increased.

Further, in the inkjet printer as above, the transporter may further include a horizontal axis rotator configured to rotate the print object about an axis parallel to a main scanning direction of the carriage, the print object being supported by the vertical moving table and being retained by the retainer.

In this invention, since the transporter includes the horizontal axis rotator that rotates the print object about the axis parallel to the main scanning direction of the carriage, the print object can be rotated about the axis parallel to the main scanning direction during printing, and thus a greater variety of types of patterns can be printed on print objects with a greater variety of types of shapes.

Further, in the inkjet printer as above, the rough position adjuster may be configured to move a printing unit including the carriage along the vertical direction, and the fine position adjuster may be configured to move the retainer along the vertical direction.

In this invention, since the rough position adjuster moves the printing unit in the vertical direction, the rough position adjuster moves the printing unit in the vertical direction, and the fine position adjuster moves the retainer. Due to this, after once having adjusted the position of the printing unit by the rough position adjuster, the position of the retainer is adjusted by the fine position adjuster during printing. Thus, since the fine position adjuster moves only the retainer in the vertical direction during printing, the distance between the outer surface of the print object and the carriage during printing can be adjusted to an appropriate distance.

Effect of the Invention

An inkjet printer and a printing method of the present invention achieve the effect of being able to print a new pattern to be printed at an appropriate position relative to an existing pattern.

Further, the inkjet printer of the present invention achieves the effect of being able to perform printing on outer surfaces of print objects with various types of shapes while suppressing burden related to preparation work.

DESCRIPTION OF EMBODIMENT

Hereinbelow, an embodiment of an inkjet printer and a printing method of the present invention will be described in detail with reference to the drawings. It should be noted that the invention herein is not limited by the embodiment. Further, the constituent features in the below embodiment include those which a person skilled in the art can replace, and those that are easy or substantially equivalent.

Embodiment

Figure 1:
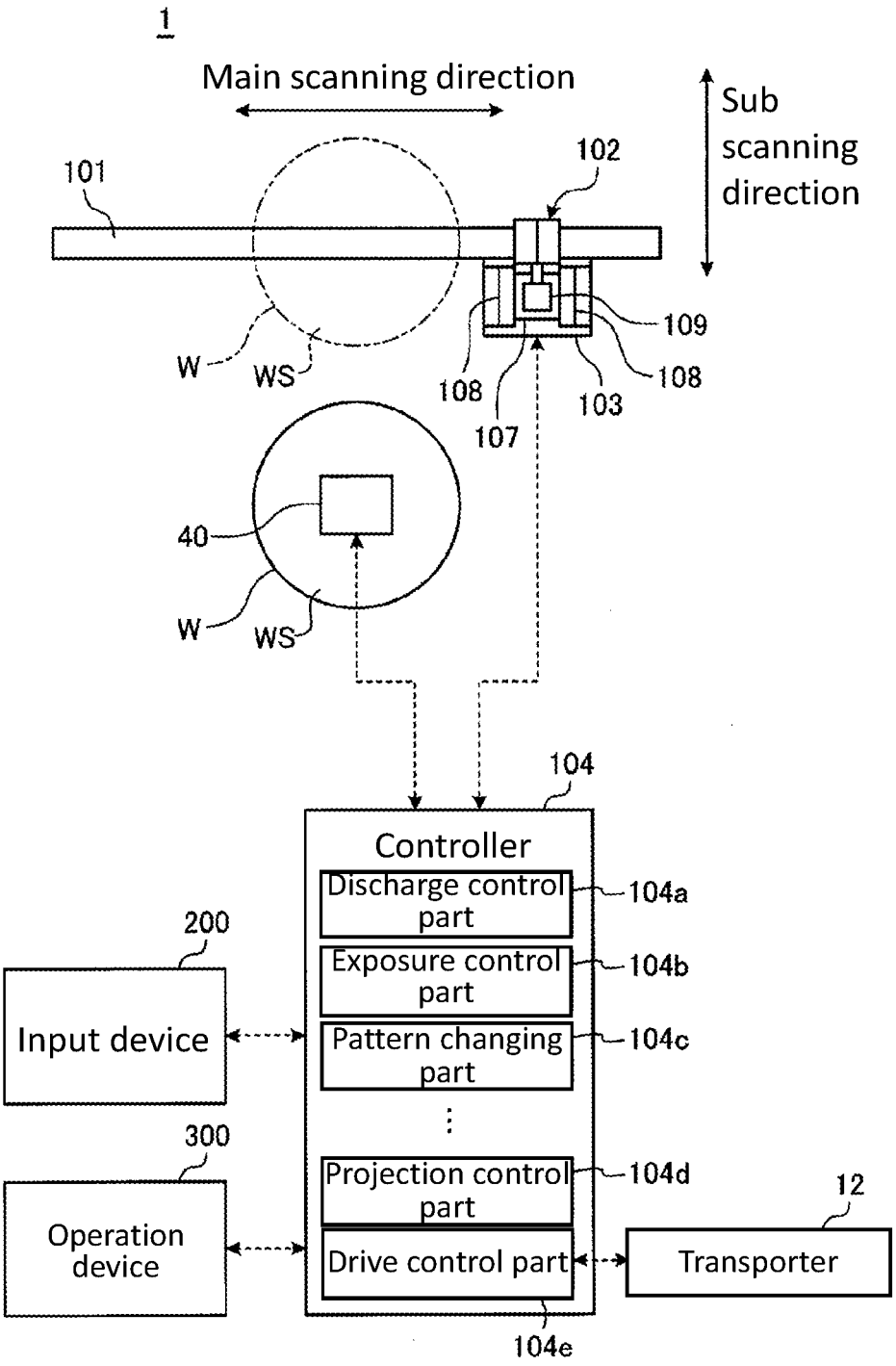
FIG. 1 is a schematic configuration diagram showing a schematic configuration of an embodiment.
Figure 2:
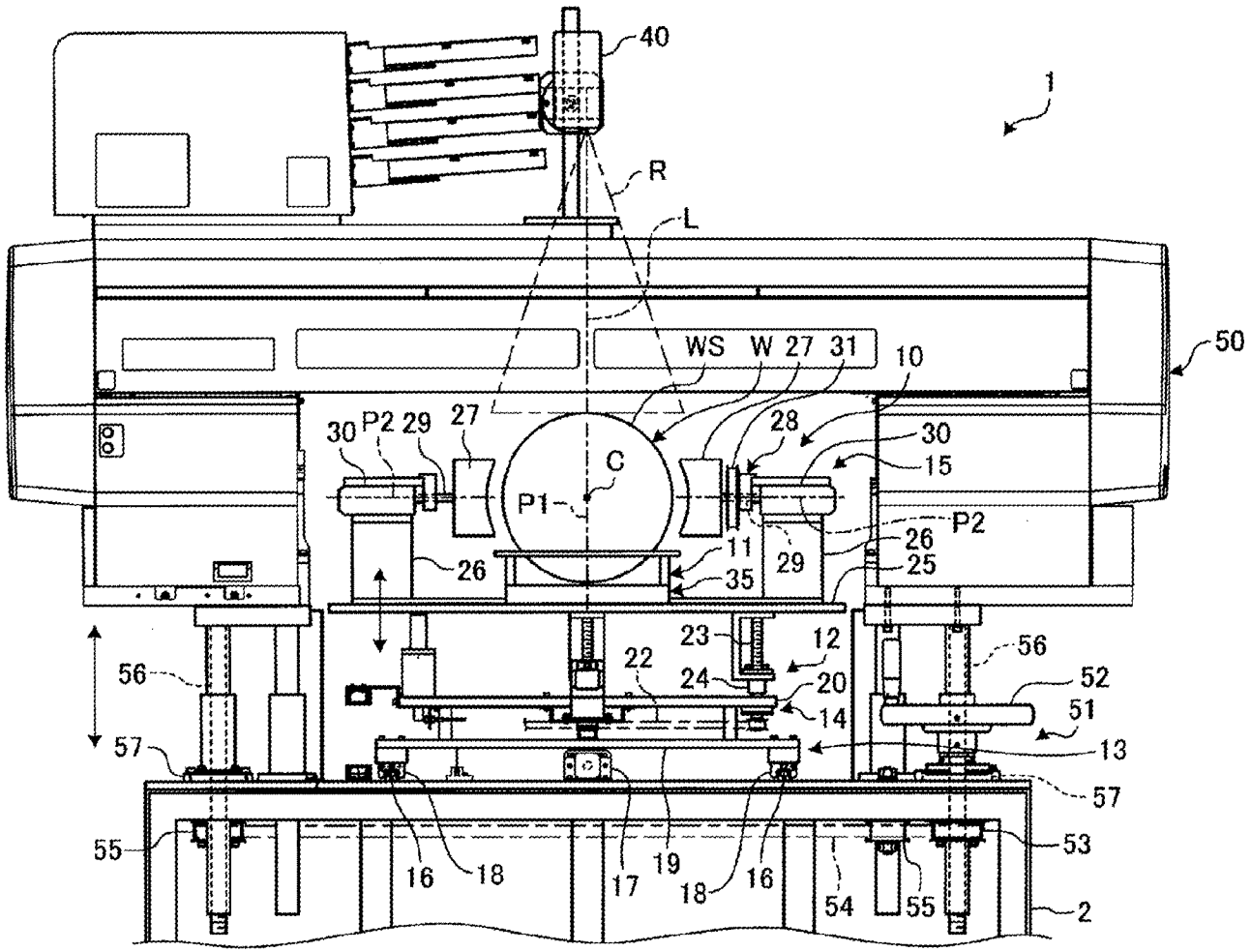
FIG. 2 is a front view of an inkjet printer of the embodiment.
Figure 3:
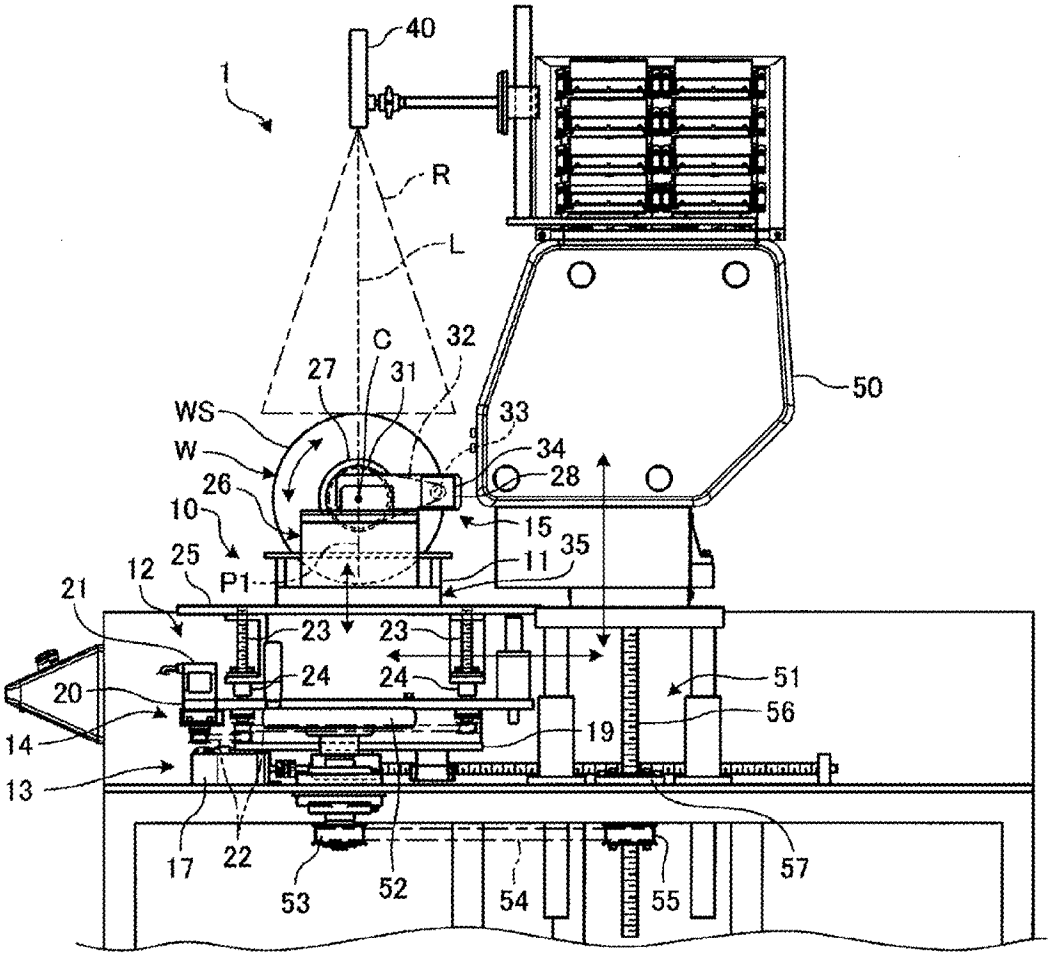
FIG. 3 is a side view of the inkjet printer of the embodiment.
Figure 4:
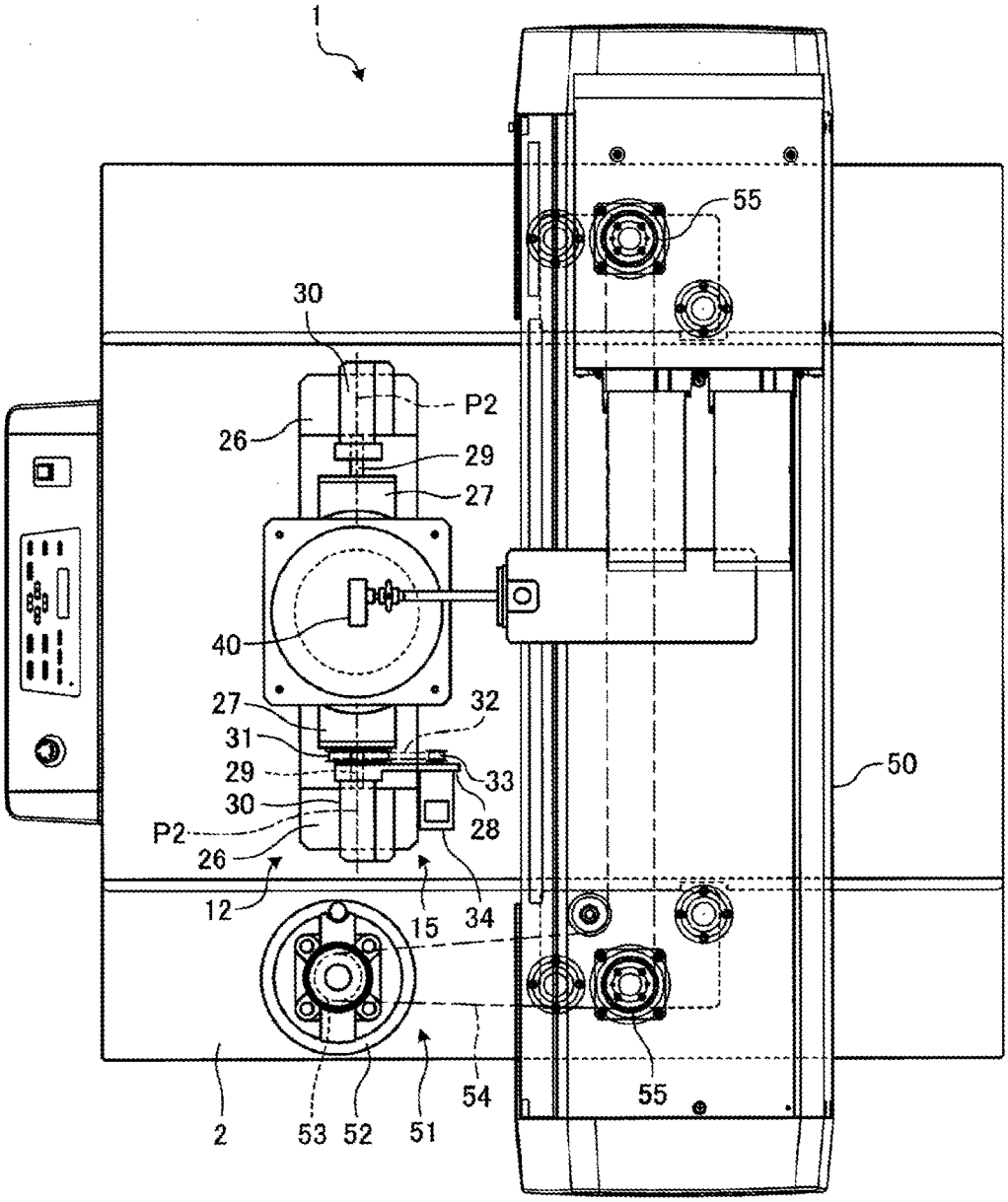
FIG. 4 is a plan view of the inkjet printer of the embodiment.
Figure 5:
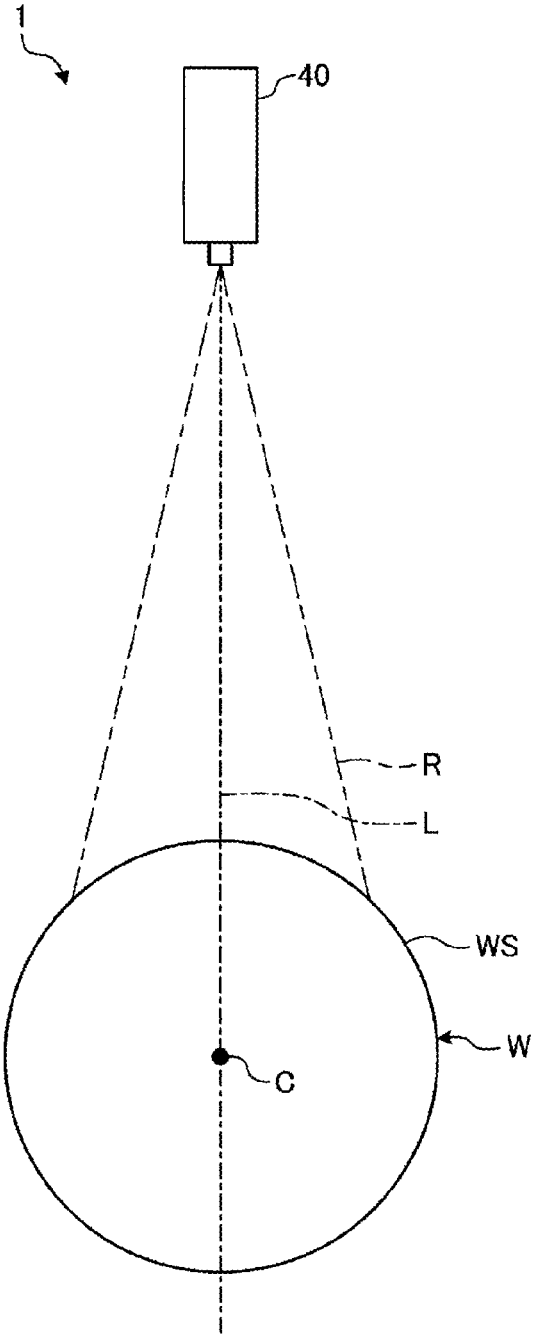
FIG. 5 is a front view showing a positional relationship of a projector and a print object of the inkjet printer of the embodiment.
Figure 6:
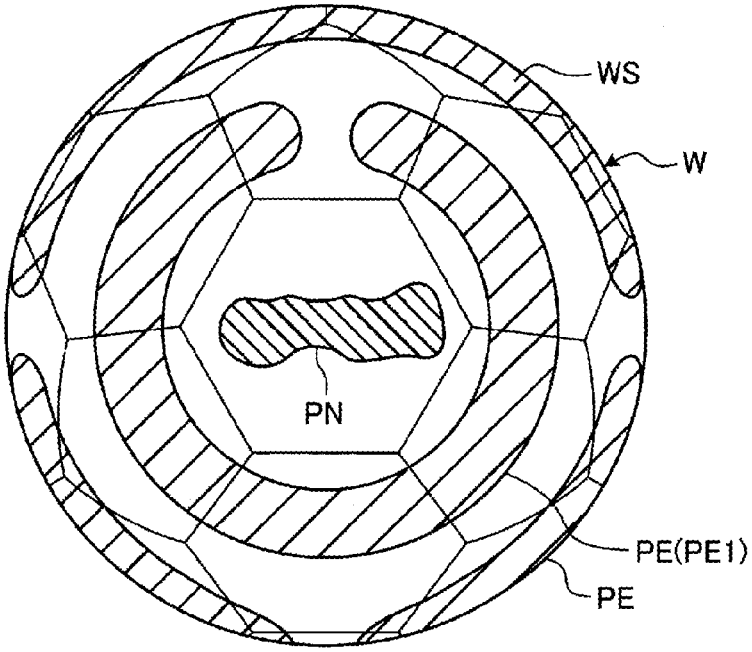
FIG. 6 is a plan view of the print object on which printing is performed by the inkjet printer of the embodiment.

FIG. 1 is a schematic configuration diagram of an inkjet printer of an embodiment. FIG. 2 is a front view of an inkjet printer of the embodiment. FIG. 3 is a side view of the inkjet printer of the embodiment. FIG. 4 is a plan view of the inkjet printer of the embodiment. FIG. 5 is a front view showing a positional relationship of a projector and a print object of the inkjet printer 1 of the embodiment. FIG. 6 is a plan view of the print object on which printing is performed by the inkjet printer of the embodiment.

The inkjet printer 1 shown in FIG. 1 discharges ultraviolet curing ink onto an outer surface WS of a three-dimensional print object W having a spherical shape for example as shown in FIG. 6 to form a pattern and the like, cures the ink by being irradiated with ultraviolet ray, and prints the pattern and the like on the outer surface WS of the print object W.

The print object W is configured by attaching a plurality of outer skin panels to the outside of a core portion that is not shown, made of a tube. The print object W in the present embodiment is a soccer ball, but no limitation is made hereto and it may be any variety of spherical shaped objects. Furthermore, in the present invention, the print object W may have a flat plate shape. Before printing is performed by the inkjet printer 1, the print object W is in an assembled state by having the plurality of outer skin panels attached to the outside of the core portion. That is, the print object W on which printing is performed by the inkjet printer 1 of the present invention is a finished product of the aforementioned soccer ball, or the like. Before printing is performed by the inkjet printer 1, the print object W has an existing pattern PE (in the embodiment, the pattern PE is a collective term for letters, drawings, shapes and the like, and a region indicated by parallel oblique lines in FIG. 6 corresponds hereto) printed on its outer surface WS. On the print object W, a new pattern to be printed PN (shown by crowded parallel oblique lines in FIG. 6), which is different from the existing pattern PE, is printed by the inkjet printer 1 at a portion within the outer surface WS where the existing pattern PE is not printed.

The inkjet printer 1 newly prints the new pattern PN to be printed on the outer surface WS of the print object W in spherical shape on which the existing pattern PE is printed. As shown in FIGS. 2 to 4, the inkjet printer 1 includes a retainer 10 that retains the print object W, a projector 40 that enlarges and projects a still image or the like, a rough position adjuster 51, a printing unit 50 provided on the retainer 10 for printing the patterns on the outer surface WS of the print object W, and a controller 104 (see FIG. 1).

The retainer 10 is provided on a device body 2 of the inkjet printer 1, and includes a retainer 11 that retains the print object W, and a transporter 12 that transports the retainer 11 between a projected position (shown by a solid line in FIG. 1) and a print position (shown by a two-dot chain line in FIG. 1).

The retainer 11 has an inner diameter in a ring shape that is smaller than an outer diameter of the print object W, and is mounted on the transporter 12. The retainer 11 retains the print object W by mounting the print object W on an upper side thereof.

The transporter 12 moves the retainer 11 between the projected position and the print position by moving the retainer 11 in a direction parallel to a sub scanning direction (shown in FIG. 1) of a carriage 103 (shown in FIG. 1) of the printing unit 50.

Here, the projected position is a position where the retainer 11 is provided under the projector 40 and a still image is projected by the projector 40 onto the print object W retained by the retainer 11. The print position is a position where the retainer 11 is provided under the printing unit 50 and the print object W retained by the retainer 11 is printed by the printing unit 50.

The transporter 12 includes a horizontal transporter 13 that moves the retainer 11 between the projected position and the print position in a direction parallel to the sub scanning direction (horizontal direction), a fine position adjuster 14 that moves the retainer 11 in the vertical direction, a vertical axis rotator 35, and a horizontal axis rotator 15 that rotates the print object W retained by the retainer 11.

The horizontal transporter 13 is provided on the device body 2. The horizontal transporter 13 includes a plurality of guide rails 16 provided with sliders 18 being parallel to the sub scanning direction and arbitrarily movable, a motor 17 that rotates a lead screw that is parallel to the sub scanning direction and is not shown about an axis thereof, and a horizontal moving table 19 attached to a nut screwed onto the lead screw and the sliders 18, and the like. The horizontal transporter 13 moves the horizontal moving table 19, that is, the retainer 11, between the projected position and the print position along the sub scanning direction by the motor 17 rotating the lead screw about the axis.

The fine position adjuster 14 is capable of changing a distance in the vertical direction between the outer surface WS of the print object W retained by the retainer 11 and the carriage 103 of the printing unit 50 by moving the retainer 11 in the vertical direction. The fine position adjuster 14 is provided on the horizontal moving table 19 of the horizontal transporter 13. The fine position adjuster 14 includes a fixed table 20 fixed on the horizontal moving table 19, a motor 21 attached to the fixed table 20, a lead screw 23 to which driving force of the motor 21 is transmitted via a belt 22 and the like and that is rotated about an axis parallel to the vertical direction, and a vertical moving table 25 attached to a nut 24 screwed onto the lead screw 23, and the like.

The vertical moving table 25 is provided above the fixed table 20, and moves in the vertical direction by the lead screw 23 being rotated by the motor 21. The vertical moving table 25 has the vertical axis rotator 35, the horizontal axis rotator 15, and the retainer 11 attached thereto, and supports these components. The fine position adjuster 14 moves the vertical moving table 25, that is, the retainer 11, along the vertical direction by the motor 21 rotating the lead screw 23 about the axis.

The vertical axis rotator 35 relatively rotates the retainer 11 and the carriage 103 about an axis P1 by rotating the retainer 11 about an axis P1 (shown in FIGS. 2 and 3) parallel to the vertical direction. The vertical axis rotator 35 is configured by including a motor and the like fixed to the vertical moving table 25. The vertical axis rotator 35 has the retainer 11 fixed on its surface. It should be noted that in the present embodiment, a center C of the print object W retained on the retainer 11 is arranged on the axis P1 being a rotation center of the retainer 11.

The horizontal axis rotator 15 is supported on the vertical moving table 25, and rotates the print object W retained by the retainer 11 about an axis P2 (shown in FIGS. 2 and 4) parallel to a main scanning direction (shown in FIG. 1) of the carriage 103. The horizontal axis rotator 15 includes a pair of clamps 26, and axial rotation units 28 that rotate clamping pads 27 of the clamps 26.

The horizontal axis rotator 15 includes the pair of clamps 26, and the axial rotation units 28 that rotate the clamping pads 27 of the clamps 26 (see FIG. 2). The pair of clamps 26 is arranged at positions clamping the retainer 11 along the main scanning direction of the printing unit 50.

The pair of clamps 26 is attached to the vertical moving table 25. This pair of clamps 26 includes cylinder units 30 that moves the clamping pads 27 attached to tips of rods 29 to advance and retreat along a direction along which they approach and separate to and from the print object W retained by the retainer 11, and the print object W is to be clamped between the clamping pads 27 when the rods 29 extend.

In each rod 29, the clamping pad 27 is supported rotatably about an axis of the rod 29. The axial rotation unit 28 includes a motor 34 fixed to the vertical moving table 25 and the like.

An output shaft of the motor 34 has a pulley 33 and the like attached thereto. The pulley 33 has a belt 32 strapped thereon, connecting to a pulley 31 provided coaxial to the clamping pad 27 of one of the clamps 26.

The horizontal axis rotator 15 rotates the print object W retained by the retainer 11 about the axis P2 parallel to the main scanning direction by the rods 29 of the cylinder unit 30 extending and clamping the print object W between the clamping pads 27, and the motor 34 rotating the clamping pads 27. Further, when the print object W is not to be rotated, in the horizontal axis rotator 15 the rods 29 contract and clearances are given to the print object W from the clamping pads 27.

Figure 7:
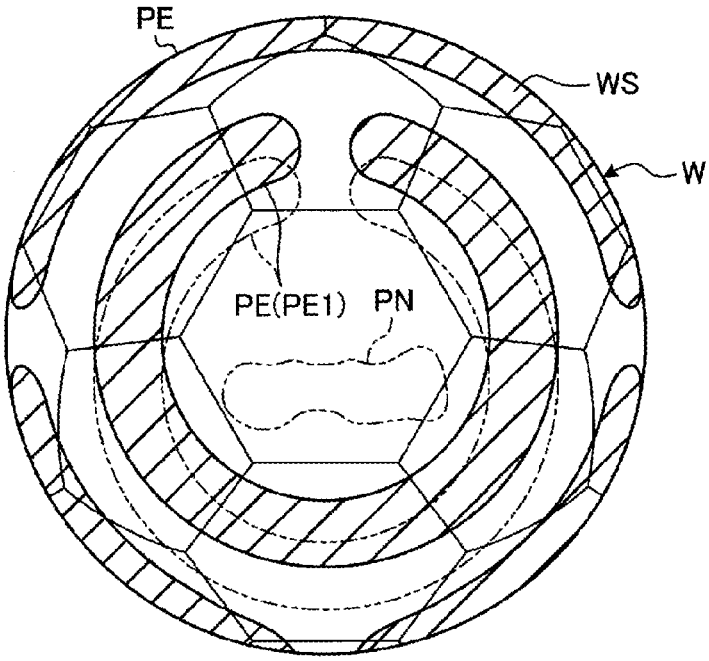
FIG. 7 is a plan view showing a state in which the projector of the inkjet printer of the embodiment is projecting a new pattern to be printed on an outer surface of the print object.

The projector 40 is configured of a well-known projector and the like provided with laser diodes that emit light of respective wavelengths for red (R), green (G), and blue (B) as its light source. The projector 40 is supported on the printing unit 50 (see FIG. 3), and is arranged above the retainer 11 at the projected position. It should be noted that FIG. 7 is a plan view showing a state in which the projector of the inkjet printer of the embodiment is projecting a new pattern to be printed on the outer surface of the print object.

As shown in FIG. 5, the projector 40 has an irradiation region R provided on a line L passing through the center C of the print object W in a front view and a side view of the inkjet printer 1, for example.

The projector 40 projects an enlarged still image of at least a part of the existing pattern PE (shown by a two-dot chain line in FIG. 7), and a new pattern to be printed PN (shown by a two-dot chain line in FIG. 7) together on the outer surface WS of the print object W retained by the retainer 11.

Further, the projector 40 projects at least a part of the existing pattern PE and the new pattern to be printed PN together by enlarging them on the outer surface WS so that they come to have about the same size as the existing pattern PE printed on the outer surface WS of the print object W.

In the present embodiment, the projector 40 projects, as at least a part of the existing pattern PE, a peripheral pattern PE1 of the existing pattern PE around the new pattern to be printed PN, together with the new pattern to be printed PN onto the outer surface WS of the print object W.

It should be noted that the peripheral pattern PE1 within the existing pattern PE and around the new pattern to be printed PN in the present invention is configured of the existing pattern PE closest to the new pattern PN over an entire periphery of the existing pattern PE taking the new pattern to be printed PN at a center. Further, the projector 40 may project all of the existing pattern PE corresponding to a semi-sphere having the new pattern to be printed PN at the center on the outer surface WS of the print object W retained by the retainer 11 from within the existing pattern PE.

The printing unit 50 is supported on the device body 2 so as to be arbitrarily movable along the vertical direction by the rough position adjuster 51 (see FIG. 3).

The rough position adjuster 51 changes the distance in the vertical direction between the outer surface WS of the print object W retained by the retainer 11 and the carriage 103 of the printing unit 50 that is to perform printing on the outer surface WS by being operated by an operator. In the present embodiment, the rough position adjuster 51 moves the printing unit 50 including the carriage 103 in the vertical direction relative to the device body 2 by being operated by the operator.

As shown in FIGS. 2 to 4, the rough position adjuster 51 includes a rotation handle 52 provided arbitrarily rotatable about an axis parallel to the vertical direction on the device body 2, and an endless belt 54 is strapped around a pulley 53 attached to the rotation handle 52 and a pair of pulleys 55, 55. A pair of lead screws 56 attached to the printing unit 50 is screwed into nuts 57 attached to the pulleys 55, and the lead screws 56 and the pair of pulleys 55 are positioned by clamping the retainer 11 at the print position in the main scanning direction of the carriage.

In the rough position adjuster 51, when the rotation handle 52 is rotated by the operator about the axis, rotation transmitted via the pulleys 55 and the like rotates the lead screws 56 about their axes, and the printing unit 50 is thereby moved in the vertical direction.

As shown in FIG. 1, the printing unit 50 includes a Y bar 101 provided in the main scanning direction, an ink tank 102, and the carriage 103. The ink tank 102 stores ink to be discharged onto the outer surface WS of the print object W positioned by the retainer 11 at the print position. Here, the ink tank 102 stores the ink for each of M (magenta), C (cyan), Y (yellow), and K (black) separately. The ink stored in the ink tank 102 is ink of which hardness changes by being irradiated with ultraviolet ray and exposed thereto (ultraviolet curing ink).

The carriage 103 is provided capable of reciprocating by the Y bar 101 provided along a main scanning direction, and includes a holder 107 that houses a pair of ultraviolet ray irradiators 108, 108 provided with an interval in between them along a main transporting direction, and a discharging unit 109 for the ink between the ultraviolet ray irradiators 108, 108.

The carriage 103 is configured to move in the main scanning direction upon printing the new pattern to be printed PN on the outer surface WS of the print object W positioned by the retainer 11 at the print position, upon which it forms a predetermined pattern on the surface of the print object W by the ink discharged from the discharging unit 109, after which it cures the ink configuring the pattern by ultraviolet ray radiated from the ultraviolet ray irradiators 108, and fixes the pattern of ink formed on the surface of the print object W.

Here, the main operating direction is a direction that vertically intersects with a print transporting direction of the print object W (sub scanning direction).

The discharging unit 109 includes a plurality of discharging nozzles (not shown), and is provided so that the plurality of discharging nozzles can discharge the ink with one of the colors of M (magenta), C (cyan), Y (yellow), and K (black) stored in the ink tank 102. The discharging unit 109 discharges the ink of the color corresponding to the printing content from the discharging nozzles. It should be noted that combinations of the colors discharged from the discharging unit 109 may be other than the aforementioned. The discharging nozzles of the discharging unit 109 are configured for example of printer heads for discharging the ink toward the print object W, respective ink passages connecting the ink tank 102 and the printer heads, regulators and pumps provided on the ink passages, and the like.

Here, the printer heads are configured by including heads for discharging the ink at the least, and are connected to the ink tank 102 via the ink passages. The discharging nozzles of the discharging unit 109 can discharge the ink in the ink tank 102 from the respective heads of the printer heads toward the print object W in an inkjet scheme at certain discharge amounts, by the pumps being driven by piezoelectric elements.

Each of the ultraviolet ray irradiators 108 can expose the ink discharged onto the print object W. Each of the ultraviolet ray irradiators 108 is configured for example by an LED module capable of radiating ultraviolet ray.

The controller 104 controls respective parts of the inkjet printer 1, including the transporter 12, the projector 40, the discharging unit 109, the ultraviolet ray irradiators 108, and the like. The controller 104 is configured by including a discharge control part 104*a*, an exposure control part 104*b*, a pattern changing part 104*c*, a projection control part 104*d*, a drive control part 104*e*, and the like in terms of functions. Further, the controller 104 is configured by including hardware such as an arithmetic unit and memory, and programs for facilitating respective functions thereof.

The discharge control part 104*a* included in the controller 104 controls the piezoelectric elements and the like of the pumps for the respective discharging nozzles of the discharging unit 109, and controls ink discharge amounts to be discharged from the discharging nozzles, discharging timings, discharging periods, and the like. The exposure control part 104*b* controls the respective ultraviolet ray irradiators 108 and the like, and controls intensity of the ultraviolet ray radiated from the ultraviolet ray irradiators 108, exposure timings, exposure periods, and the like. The pattern changing part 104*c* sets the discharge control amounts and exposure control amounts according to input information input from an input device 200 such as a PC connected by wire or wirelessly to the controller 104, or various types of terminals.

The pattern changing part 104*c* is input with the input information such as image information input for example through the input device 200, including the new pattern to be printed PN (such as characters, drawings, or shapes) to be printed on the outer surface WS of the print object W. The pattern changing part 104*c* generates a print pattern to be the new pattern to be printed PN desired to be printed on the outer surface WS of the print object W based on this input information, and converts the generated print pattern into the discharge control amounts and the exposure control amounts that can facilitate it. Then, the discharge control part 104*a* controls the discharge from the discharging nozzles of the discharging unit 109 based on the discharge control amounts calculated by the pattern changing part 104*c*, and the exposure control part 104*b* controls the exposure by the ultraviolet ray irradiators 108 based on the exposure control amounts calculated by the pattern changing part 104*c*.

The projection control part 104*d* sets the still image that the projector 40 is to project according to the input information input from the input device 200 such as the PC connected by wire or wirelessly to the controller 104, or the various types of terminals. The projection control part 104*d* is input with the input information such as image information input for example through the input device 200, including at least a part of the existing pattern PE and the new pattern to be printed PN desired to be projected on the outer surface WS of the print object W. The projection control part 104*d* generates a projection pattern that is to be the part of the existing pattern PE and the new pattern to be printed PN desired to be projected on the outer surface WS of the print object W based on this input information, and controls the projection by the projector 40 based on the generated projection pattern.

The drive control part 104*e* generates driving patterns for the motors 17, 21, 34 of the transporter 12 and the cylinder unit 30 based on the programs stored in advance, and controls the motors 17, 21, 34 of the transporter 12, the cylinder unit 30, and the motor of the vertical axis rotator 35 based on the generated driving patterns.

Further, the controller 104 controls operations of the projector 40, the transporter 12, the printing unit 50, and the like according to operation instructions input from an operation device 300 configured of a plurality of button switches and the like. Further, the operation device 300 is used to suitably change a position, size, and patterns of the new pattern PN projected by the projector 40 and printed by the printing unit 50.

During when the ink is discharged from the discharging unit 109 and printing is performed on the print object W (during printing), the controller 104 detects a distance in the vertical direction between the outer surface WS of the print object W retained by the retainer 11 where the ink discharged from the discharging nozzles adhere and the discharging nozzles of the carriage 103 by a sensor not shown but provided on the printing unit 50. The controller 104 controls the motor 21 of the fine position adjuster 14 so that the distance in the vertical direction detected by the aforementioned sensor during the printing by the carriage 103 becomes an appropriate distance.

The inkjet printer 1 configured as above discharges the ink by a predetermined printing width by the discharging unit 109 onto the outer surface WS of the print object W while the carriage 103 reciprocates in the main scanning direction relative to the print object W positioned by the retainer 11 at the print position according to the control by the controller 104. Further, in the inkjet printer 1, the ultraviolet ray irradiators 108 radiate the ultraviolet ray and perform exposure at predetermined timings according to the control by the controller 104 to cure the ink that has struck onto the print object W. By doing so, the carriage 103 prints the new pattern to be printed PN on the outer surface WS of the print object W.

Further, the inkjet printer 1 can change an amount of the ink to be discharged and a discharging speed according to the aforementioned distance between the outer surface WS of the print object W and the discharging nozzles by changing driving voltages of the piezoelectric elements for the respective discharging nozzles and the like. Further, in making the amount of the ink to be discharged larger, in addition to making a size of each droplet of the ink to be discharged large, discharged plurality of ink liquid can be combined in the air by making an ink discharging interval small using the speed of the ink liquid discharged previously being slower than the speed of the ink liquid discharged consecutively thereafter.

In the inkjet printer 1, when the motion of the carriage 103 in the main scanning direction and the ink discharge at the predetermined printing width are completed, the carriage 103 and the print object W are moved relatively by the transporter 12 by the aforementioned predetermined printing width in a sub scanning direction (print transport direction).

Then, the print object W retained by the retainer 11 is rotated about the axis P2 along the main scanning direction (see FIG. 4) and the axis P1 along the vertical direction (see FIG. 2), and the print object W retained by the retainer 11 is moved suitably in the vertical direction by the motor 21 of the fine position adjuster 14.

Further, by repeating these motions and rotations, the new pattern to be printed PN is printed onto the outer surface WS of the print object W.

During this period, in the controller 104, the discharge control part 104*a* controls the ink discharge amounts to be discharged from the discharging nozzles of the discharging unit 109, the discharging timings, the discharging periods, and the like, and the exposure control part 104*b* controls the intensity and the like of the ultraviolet ray radiated from the ultraviolet ray irradiators 108. According to this, the inkjet printer 1 can print the new pattern PN on the outer surface WS of the print object W in accordance with the print pattern generated by the pattern changing part 104*c*.

Next, a printing method using the aforementioned inkjet printer 1 will be described. The printing method is a method of newly printing the new pattern to be printed PN, which is different from the existing pattern PE, on the outer surface WS of the print object W in spherical shape on which the existing pattern PE is printed. In this printing method, firstly, the operator registers process content information configured of the image information of at least a part of the existing pattern PE and the new pattern to be printed PN that the projector 40 is to project, from the input device 200, and printing is started when a start instruction of process operation is input from the operation device 300. When the start instruction of the process operation is input from the operation device 300, the controller 104 positions the retainer 11 at the projected position, and projects at least a part of the existing pattern PE and the new pattern to be printed PN together from the projector 40 onto the retainer 11. Then, the operator mounts the print object W on the retainer 11. In so doing, as shown in FIG. 7, at least a part of the existing pattern PE (shown by the two-dot chain line in FIG. 7) and the new pattern PN (shown by the two-dot chain line in FIG. 7) are projected on the outer surface WS of the print object W on which the existing pattern PE is printed.

Then, the operator positions the print object W on the retainer 11 based on the projected existing pattern PE and the existing pattern PE already printed on the outer surface WS of the print object W.

At this occasion, the operator adjusts the position of the print object W relative to the retainer 11 so that the projected existing pattern PE overlaps with the existing pattern PE already printed on the outer surface WS of the print object W. Then, the operator positions the print object W at the position where the projected existing pattern PE overlaps with the existing pattern PE already printed on the outer surface WS of the print object W.

Thereafter, the operator rotates the rotation handle 52 to adjust a height of the printing unit 50 to a height by which the print object W retained by the retainer 11 can move to the print position. Then, a print start instruction is input from the operation device 300. It should be noted that upon adjusting the height of the printing unit 50, the adjustment is preferably performed so that the distance between the printing unit 50 and the outer surface WS of the print object W retained by the retainer 11 becomes small as possible.

Then, the controller 104 moves the retainer 11 that is retaining the print object W to the print position by the transporter 12.

The controller 104 (1) performs printing by the predetermined printing width on the outer surface WS of the print object W by discharging the ink from the discharging unit 109 while moving the carriage 103 in the main scanning direction.

Then, when the motion in the main operating direction is completed, (2) the carriage 103 and the print object W are moved relatively in the sub operating direction by the predetermined printing width, after which (3) the print object W retained by the retainer 11 is suitably rotated about the axis P2 along the main scanning direction (see FIG. 4) and the axis P1 along the vertical direction (see FIG. 2), and the print object W retained by the retainer 11 is suitably moved in the vertical direction by the fine position adjuster 14.

Further, by repeating these (1) to (3), the new pattern to be printed PN is printed onto the outer surface WS of the print object W.

When the printing of the new pattern to be printed PN is completed, the controller 104 stops moving the carriage 103 in the main scanning direction, and then moves the retainer 11 that is retaining the print object W to the projected position. Then, the operator detaches the print object W on which the new pattern to be printed PN has been printed from the retainer 11, and the printing method is thereby finished.

The inkjet printer 1 of the embodiment includes the projector 40 that projects at least a part of the existing pattern PE and the new pattern to be printed PN, and the printing method of the embodiment performs printing on the print object W using the inkjet printer 1 provided with the projector 40.

Thus, the print object W can easily be positioned at a specified position prior to the execution of the printing based on at least a part of the existing pattern PE that the projector 40 projects and the existing pattern PE printed on the outer surface WS of the print object W.

Further, the projector 40 projects at least a part of the existing pattern PE and the new pattern to be printed PN onto the outer surface WS of the print object W.

Due to this, in positioning the print object W, not only the position and printing area of the new pattern to be printed PN but also the pattern on the outer surface WS of the print object W after the printing (such as color and design) can easily be grasped together with the existing pattern PE already printed on the print object W and the surface concave and convex on the outer surface WS of the print object W.

Further, since the projector 40 projects the peripheral pattern P1, being a part of the existing pattern PE, around the new pattern to be printed PN, the print object W can easily be positioned based on the projected patterns PE, PN, and the like.

Further, since the projector 40 arranges an irradiation region R on the line passing through the center C of the print object W, the patterns PE, PN projected by the projector 40 can be prevented from distorting on the outer surface WS of the print object W.

Further, it is provided with the transporter 12 that transports the retainer 11 between the projected position and the print position, and in moving from the projected position to the print position, the position of the print object W positioned on the retainer 11 is maintained while moving to the print position.

Due to this, the new pattern to be printed PN can be printed on the outer surface WS of the print object W at the print position after having positioned the print object W relative to the retainer 11 at the projected position, thus the pattern of the new pattern PN to be generated by the printing will not be displaced.

Further, the carriage 103 prints the new pattern to be printed PN on the outer surface WS of the print object W while moving in the main scanning direction parallel to the horizontal direction. Due to this, the motion of the carriage 103 becoming complicated during printing, and the need to change the driving voltages of the piezoelectric elements for discharging the ink depending on the position of the carriage 103 can suitably be suppressed.

In the inkjet printer 1 of the embodiment, a rough adjustment of the distance in the vertical direction between the outer surface WS of the print object W retained by the retainer 11 and the discharging unit 109 of the carriage 103 can be performed by the rough position adjuster 51, and a suitable adjustment is performed during the printing so that the distance in the vertical direction between the outer surface WS of the print object W and the discharging unit 109 of the carriage 103 becomes a suitable distance by the fine position adjuster 14 controlled by the controller 104. Thus, in this inkjet printer 1, since the printing on print objects W having various types of shapes is enabled by retaining the print object W by the retainer 11, burden on preparation work is suppressed while at the same time the printing can be performed on the outer surfaces WS of the print objects W having various types of shapes.

Further, in the inkjet printer 1, the rough adjustment of the distance in the vertical direction between the outer surface WS of the print object W retained by the retainer 11 and the discharging unit 109 of the carriage 103 can be performed by the rough position adjuster 51. Due to this, the inkjet printer 1 can suppress a range in which the distance in the vertical direction between the outer surface WS of the print object W and the carriage 103 that the fine position adjuster 14 adjusts during the printing.

That is, the inkjet printer 1 can suppress the range in which the fine position adjuster 14 moves the retainer 11 in the vertical direction during the printing. Thus, the inkjet printer 1 can suppress the time required for performing printing on the outer surface WS of the print object W even by moving the retainer 11 in the vertical direction during the printing.

Further, the inkjet printer 1 is provided with the horizontal transporter 13 with which the transporter 12 moves the retainer 11 in the sub scanning direction, so that the print object W retained by the retainer 11 can be moved in the sub scanning direction as needed during printing, and the printing can surely be performed on the outer surfaces WS of the print objects W having various types of shapes. Further, since the transporter 12 moves the retainer 11, that is, the print object W in the sub scanning direction relative to the carriage 103, a follow-up speed for the print object W in the sub scanning direction can be increased as compared to a case of moving the printing unit 50 in the sub scanning direction.

Further, the inkjet printer 1 supports the fine position adjuster 14 on the horizontal moving table 19 of the horizontal transporter 13, so that the fine position adjuster 14 moves the retainer 11, that is, the print object W, in the vertical direction. Thus, the inkjet printer 1 can increase a follow-up speed by the fine position adjuster 14 for the distance between the outer surface WS of the print object W and the discharging unit 109 of the carriage 103 as compared to a case of moving the printing unit 50 in the vertical direction.

Further, in the inkjet printer 1, since the transporter 12 includes the vertical axis rotator 35 that relatively rotates the retainer 11, that is, the print object W, and the carriage 103 about the axis P1 parallel to the vertical direction, the print object W can be rotated about the axis P1 parallel to the vertical direction during the printing, and a greater variety of types of patterns can be printed on print objects W with a greater variety of types of shapes.

Further, since the inkjet printer 1 supports the vertical axis rotator 35 on the vertical moving table 25, the fine position adjuster 14 rotates the retainer 11 about the axis P1 parallel to the vertical direction, as a result of which the follow-up speed by the fine position adjuster 14 about the aforementioned axis P1 can be increased.

Further, in the inkjet printer 1, since the transporter 12 includes the horizontal axis rotator 15 that rotates the print object W about the axis P2 parallel to the main scanning direction of the carriage 103, the print object W can be rotated about the axis P2 parallel to the main scanning direction during the printing, and a greater variety of types of patterns can be printed on print objects W with a greater variety of types of shapes.

Further, in the inkjet printer 1, since the rough position adjuster 51 moves the printing unit 50 in the vertical direction, the rough position adjuster 51 moves the printing unit 50 in the vertical direction, and the fine position adjuster 14 moves the retainer 11. Due to this, after once having adjusted the position of the printing unit 50 by the rough position adjuster 51, the position of the retainer 11 is adjusted by the fine position adjuster 14 during the printing. Thus, in the inkjet printer 1, since the fine position adjuster 14 moves only the retainer 11 in the vertical direction during the printing, the distance between the outer surface WS of the print object W and the carriage 103 during the printing can be adjusted to an appropriate distance.

Further, in the inkjet printer 1, the projector 40 that projects at least a part of the existing pattern PE and the new pattern to be printed PN is provided in the inkjet printer 1. Thus, the inkjet printer 1 and the printing method can easily position the print object W at the specified position prior to the printing by the carriage 103 based on at least a part of the existing pattern PE that the projector 40 projects and the existing pattern PE printed on the outer surface WS of the print object W.

Further, in the inkjet printer 1, the projector 40 projects at least a part of the existing pattern PE and the new pattern to be printed PN on the outer surface WS of the print object W. Due to this, upon positioning the print object W and the like, the inkjet printer 1 and the printing method can easily grasp not only the position and the printing area of the new pattern to be printed PN but also the pattern of the outer surface WS of the print object W after the printing (such as colors and design) together with the existing pattern PE already printed on the print object W and the surface concave and convex on the outer surface WS of the print object W.

Further, in the inkjet printer 1, since the projector 40 projects the peripheral pattern P1, being a part of the existing pattern PE, around the new pattern to be printed PN, the print object W can easily be positioned based on the projected patterns PE (PE1), PN, and the like.

Further, in the inkjet printer 1, since the projector 40 arranges the irradiation region R on the line passing through the center C of the print object W, the patterns PE, PN projected by the projector 40 can be prevented from distorting on the outer surface WS of the print object W.

In the aforementioned embodiment, the print object W is a spherical soccer ball, but no limitation is made hereto and it may be any variety of three-dimensional objects. In the present invention, the print object W is not limited to spherical objects, but may be shoes such as sport shoes, tires or shafts for respective types of vehicles, which in summary means that the print object W may be anything having a three-dimensional shape. It should be noted that in the present invention, the retainer 11 is preferably changed to those with suitable shapes according to the shape of the print object W.

Further, in the present invention, the horizontal transporter 13, the fine position adjuster 14, and the vertical axis rotator 35 of the transporter 12 may not move the retainer 11 but may move the carriage 103 of the printing unit 50 in the predetermined directions, or both of the retainer 11 and the carriage 103 of the printing unit 50 may be moved in the predetermined directions. Moreover, in the present invention, the rough position adjuster 51 may not move the carriage 103 of the printing unit 50 in the vertical direction, but may move the retainer 11 in the vertical direction, or may move both of the retainer 11 and the carriage 103 in the vertical direction.

Variant 1

Figure 8:
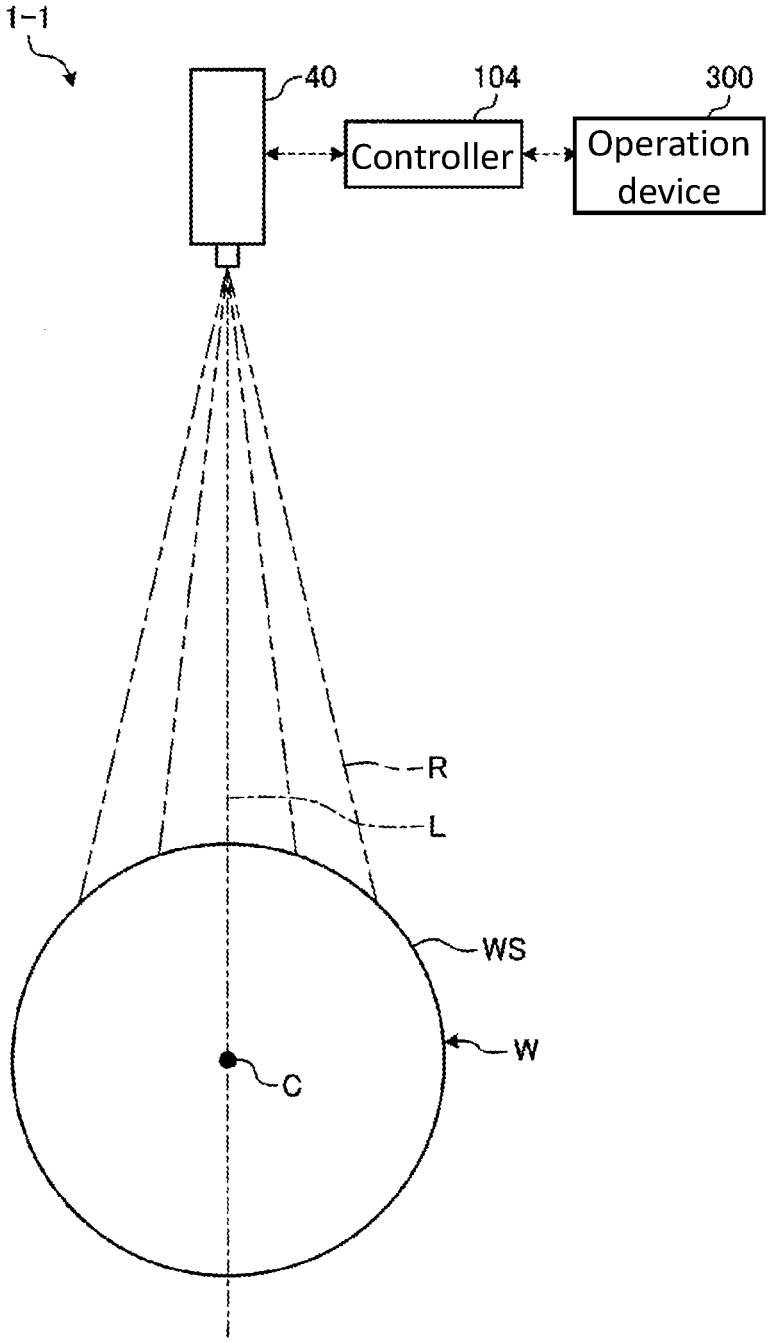
FIG. 8 is a front view showing a positional relationship of a projector and a print object of an inkjet printer of a variant 1 of the embodiment.
Figure 9:
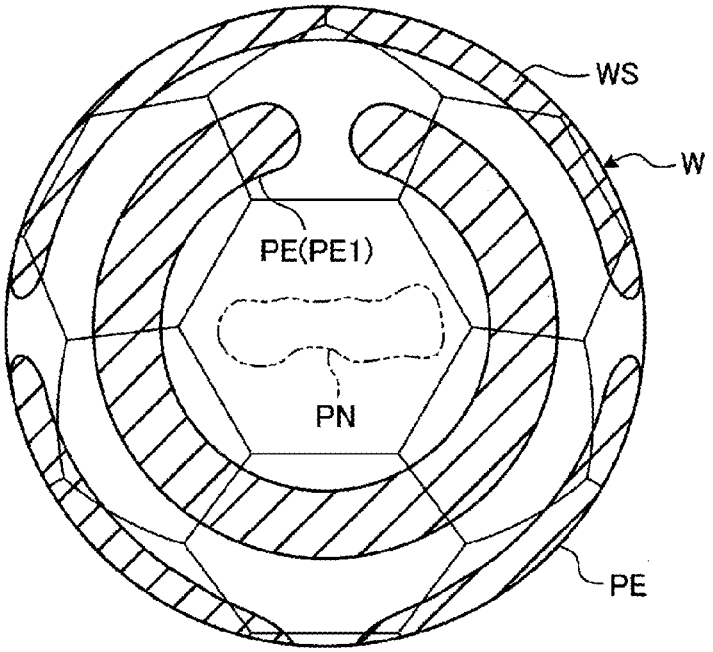
FIG. 9 is a plan view showing a state in which the projector of the inkjet printer of the variant 1 of the embodiment is projecting a new pattern to be printed on an outer surface of the print object.

Next, an inkjet printer 1-1 and a printing method of a variant 1 of the aforementioned embodiment will be described. FIG. 8 is a front view showing a positional relationship of a projector and a print object of an inkjet printer of the variant 1 of the embodiment. FIG. 9 is a plan view showing a state in which the projector of the inkjet printer of the variant 1 of the embodiment is projecting a new pattern to be printed on an outer surface of the print object. It should be noted that in FIGS. 8 and 9, the portions identical to those of the embodiment are given the same reference signs, and the description thereof will be omitted.

In the inkjet printer 1-1 of the variant 1, the projector 40 projects only the new pattern to be printed PN (shown by a two-dot chain line in FIG. 9) on the outer surface WS of the print object W retained by the retainer 11. Further, in the inkjet printer 1-1 of the variant 1, the operation device 300 is used for suitably changing the position, size, and the pattern of the new pattern PN that the projector 40 is to project and the printing unit 50 is to print.

In the printing method using the inkjet printer 1-1 of the variant 1, firstly the operator registers the process content information configured of the image information of the new pattern to be printed PN from the input device 200, and when the start instruction of process operation is input from the operation device 300, printing is then started.

When the start instruction of the process operation is input from the operation device 300, the controller 104 positions the retainer 11 at the projected position, and projects the new pattern to be printed PN from the projector 40 onto the retainer 11. Then, the operator mounts the print object W on the retainer 11. In so doing, as shown in FIG. 9, the new pattern to be printed PN (shown by the two-dot chain line in FIG. 9) is projected on the outer surface WS of the print object W on which the existing pattern PE is printed.

Then, the operator positions the print object W on the retainer 11 based on the new pattern to be printed PN as projected and the existing pattern PE already printed on the outer surface WS of the print object W. At this occasion, the operator operates the operation device 300 to adjust the position and size of the new pattern to be printed PN so as to suppress distortion of the new pattern PN that the projector 40 is to project and the printing unit 50 is to print, especially at an outer edge portion. By so doing, in the variant 1, the print region on the outer surface WS of the print object W on which printing is to be performed by the carriage 103 is changed based on the new pattern to be printed PN projected on the outer surface WS. Especially, in the variant 1, it is preferable to set the irradiation region R at a range closer to the center than a position shown by a one-dot chain line in FIG. 8, for example, in the range shown by a two-dot chain line.

Thereafter, the operator rotates the rotation handle 52 to adjust the height of the printing unit 50, and enters the print start instruction from the operation device 300. Then, the controller 104 moves the retainer 11 that is retaining the print object W to the print position by the transporter 12. The controller 104 prints the new pattern to be printed PN on the outer surface WS of the print object W by the carriage 103 of the inkjet printer 1 while moving the carriage 103 in the main scanning direction, moving the print object W in the sub scanning direction by the transporter 12, rotating the print object W suitably about the axis parallel to the main scanning direction by the horizontal axis rotator 15, and moving the retainer 11 in the vertical direction suitably by the fine position adjuster 14.

The details of the printing are similar to those of the aforementioned embodiment.

When the printing of the new pattern to be printed PN is completed, the controller 104 stops moving the carriage 103 in the main scanning direction, and then moves the retainer 11 that is retaining the print object W to the projected position. Then, the operator detaches the print object W on which the new pattern to be printed PN has been printed from the retainer 11, and the printing method is thereby finished.

According to the inkjet printer 1-1 and the printing method of the variant 1, due to the new pattern to be printed PN being projected on the outer surface WS of the print object W, the print object W can easily be positioned at the specified position prior to the printing by the carriage 103 based on the new pattern to be printed PE that is projected and the existing pattern PE printed on the outer surface WS of the print object W.

Further, upon positioning the print object W and the like, the inkjet printer 1-1 and the printing method of the variant 1 can easily grasp not only the position and the printing area of the new pattern to be printed PN but also the pattern of the outer surface WS of the print object W after the printing (such as colors and design) together with the existing pattern PE already printed on the print object W and the surface concave and convex on the outer surface WS of the print object W.

Further, in the inkjet printer 1-1 and the printing method of the variant 1, since the print region is changed based on the new pattern to be printed PN that is projected on the outer surface WS of the print object W, the new pattern to be printed PN can accurately be printed on the outer surface WS of the print object W by setting the print region at a position where the projected new pattern to be printed PN is not distorted.

Variant 2

Figure 10:
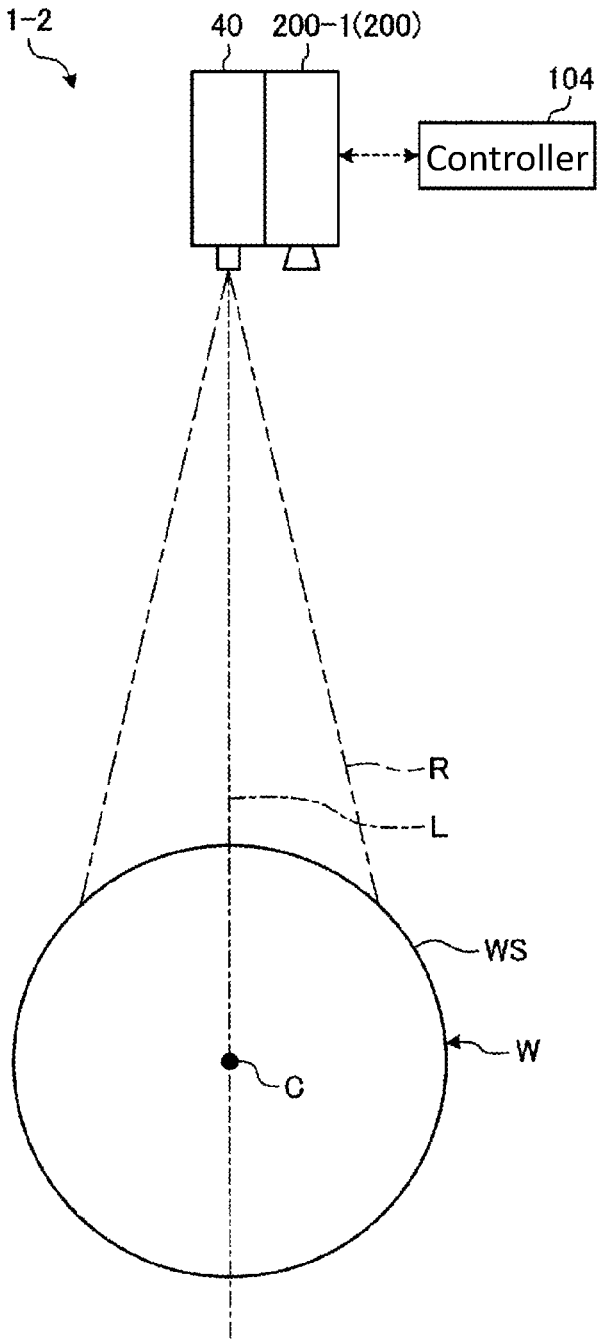
FIG. 10 is a front view showing a positional relationship of a projector and a print object of an inkjet printer of a variant 2 of the embodiment.

Next, an inkjet printer 1-2 and a printing method of a variant 2 of the aforementioned embodiment will be described. FIG. 10 is a front view showing a positional relationship of a projector and a print object of an inkjet printer of the variant 2 of the embodiment. It should be noted that in FIG. 10, the portions identical to those of the embodiment are given the same reference signs, and the description thereof will be omitted.

In the inkjet printer 1-2 of the variant 2, an imaging device 200-1 configured of a CCD camera and the like is used as the input device 200. The imaging device 200-1 is provided next to the projector 40 for example, as shown in FIG. 10, captures an image of the existing pattern PE printed on the outer surface WS of the print object W retained by the retainer 11 at the print position, and inputs the image information of the existing pattern PE acquired by capturing as the input information to the controller 104. In the inkjet printer 1-2 of the variant 2, upon capturing an image of the outer surface WS of the print object W using the imaging device 200-1, it is preferable to capture the image of the outer surface WS of the print object W positioned at the specified position based on the new pattern PN and the like, by projecting the new pattern to be printed PN onto the outer surface WS of the print object W from the projector 40. Further, in the inkjet printer 1-2 of the variant 2, the projection control part 104*d* of the controller 104 preferably corrects the image information from a positional relationship of the projector 40 and the imaging device 200-1, a positional relationship of the imaging device 200-1 and the retainer 11, and the like.

According to the inkjet printer 1-2 and the printing method of the variant 2, similar to the embodiment, the print object W can easily be positioned at the specified position, and in addition to being able to easily grasp the pattern of the outer surface WS of the print object W after the printing (such as colors and design), the information of the existing pattern PE printed on the outer surface WS of the print object W can easily be input to the controller 104.

As aforementioned, the embodiment, the variants 1 and 2 of the present invention have been described, but the present invention is not limited hereto. In the present invention, the embodiment and the variants 1 and 2 can be carried out in various other configurations, and various omissions, replacements, and changes to combinations may be made within the scope that does not go beyond the essence of the invention.

The invention claimed is:

1. An inkjet printer configured to newly print a new pattern to be printed on an outer surface of a print object in spherical shape on which an existing pattern is printed, the new pattern being different from the existing pattern, the inkjet printer comprising:

a retainer, configured to retain the print object;

a carriage, configured to print the new pattern to be printed on the outer surface of the print object; and a projector, configured to project the new pattern to be printed on the outer surface of the print object retained by the retainer, wherein the carriage moves in a horizontal direction to print the new pattern to be printed on the outer surface of the print object.

2. The inkjet printer according to claim 1, wherein the projector is configured to project, from within the existing pattern, a peripheral pattern of the new pattern to be printed as the part of the existing pattern on the outer surface of the print object together with the new pattern to be printed.

3. The inkjet printer according to claim 1, wherein the projector arranges an irradiation region on a line passing through a center of the print object.

4. The inkjet printer according to claim 1, further comprising:

a transporter that transports the retainer between a projected position where the print object is projected by the projector and a print position where printing is performed on the print object by the carriage.

5. An inkjet printer configured to newly print a new pattern to be printed on an outer surface of a print object in spherical shape on which an existing pattern is printed, the new pattern being different from the existing pattern, the inkjet printer comprising:

a retainer, configured to retain the print object;

a carriage, configured to print the new pattern to be printed on the outer surface of the print object; and a projector, configured to project the new pattern to be printed on the outer surface of the print object retained by the retainer;

wherein the projector, being configured to project at least a part of the existing pattern and the new pattern to be printed together on the outer surface of the print object retained by the retainer.

6. The inkjet printer according to claim 5, wherein the projector arranges an irradiation region on a line passing through a center of the print object.

7. The inkjet printer according to claim 5, further comprising:

a transporter that transports the retainer between a projected position where the print object is projected by the projector and a print position where printing is performed on the print object by the carriage.

8. The inkjet printer according to claim 5, wherein the carriage moves in a horizontal direction to print the new pattern to be printed on the outer surface of the print object.

9. A printing method of newly printing a new pattern to be printed on an outer surface of a print object in spherical shape on which an existing pattern is printed, the new pattern being different from the existing pattern, the printing method comprising printing the new pattern to be printed on the outer surface of the print object by a carriage of an inkjet printer after having projected the new pattern to be printed on the outer surface of the print object, and the print object is positioned based on the new pattern to be printed which is projected and the existing pattern printed on the outer surface of the print object.

10. The printing method according to claim 9, further comprising:

changing a print region of the print object on which printing is performed by the carriage of the inkjet printer based on the new pattern to be printed projected on the outer surface of the print object.

11. The printing method according to claim 9, wherein the printing the new pattern after having projected at least a part of the existing pattern and the new pattern to be printed together on the outer surface of the print object.

12. An inkjet printer configured to perform printing on an outer surface of a print object in three-dimensional shape, the inkjet printer comprising:

a retainer, configured to retain the print object;

a rough position adjuster, configured to change a distance in a vertical direction between the outer surface of the print object retained by the retainer and a carriage that is to perform printing on the outer surface;

a transporter, including a fine position adjuster capable of changing the distance in the vertical direction between the outer surface of the print object retained by the retainer and the carriage; and a controller, configured to control the fine position adjuster so that the distance in the vertical direction between the outer surface of the print object retained by the retainer and the carriage becomes a suitable distance during the printing by the carriage.

13. The inkjet printer according to claim 12, wherein the transporter further includes: a horizontal transporter that moves the retainer along a sub scanning direction of the carriage.

14. The inkjet printer according to claim 13, wherein the horizontal transporter further includes: a horizontal moving table that supports and moves the fine position adjuster along the sub scanning direction, and the fine position adjuster moves the retainer along the vertical direction.

15. The inkjet printer according to claim 14, wherein the transporter further includes: a vertical axis rotator configured to relatively rotate the retainer and the carriage about an axis parallel to the vertical direction.

16. The inkjet printer according to claim 15, wherein the fine position adjuster includes: a vertical moving table that supports and moves the vertical axis rotator along the vertical direction, and the vertical axis rotator is configured to rotate the retainer about the axis parallel to the vertical direction.

17. The inkjet printer according to claim 16, wherein the transporter further includes: a horizontal axis rotator configured to rotate the print object about an axis parallel to a main scanning direction of the carriage, the print object being supported by the vertical moving table and being retained by the retainer.

18. The inkjet printer according to claim 12, wherein the rough position adjuster is configured to move a printing unit including the carriage along the vertical direction, and the fine position adjuster is configured to move the retainer along the vertical direction.

* * * * *